US007381159B2

(12) United States Patent
Ho

(10) Patent No.: US 7,381,159 B2
(45) Date of Patent: Jun. 3, 2008

(54) STEPPER

(76) Inventor: Wei-Teh Ho, P.O. Box 24-108, Taipei (TW)

( * ) Notice: Subject to any disclaimer, the term of this patent is extended or adjusted under 35 U.S.C. 154(b) by 128 days.

(21) Appl. No.: 11/489,946

(22) Filed: Jul. 20, 2006

(65) Prior Publication Data

US 2008/0020904 A1 Jan. 24, 2008

(51) Int. Cl.
*A63B 22/04* (2006.01)
*A63B 21/12* (2006.01)

(52) U.S. Cl. ..... 482/52; 482/114

(58) Field of Classification Search ..... 482/51, 482/52, 57, 70, 114–119
See application file for complete search history.

(56) References Cited

U.S. PATENT DOCUMENTS 3,843,118 A * 10/1974 Annas et al. ..... 482/118
4,600,187 A * 7/1986 Schenker ..... 482/52
5,460,586 A * 10/1995 Wilkinson et al. ..... 482/54
5,584,780 A * 12/1996 Lin ..... 482/51
5,807,210 A * 9/1998 Devlin ..... 482/52
5,833,575 A * 11/1998 Holslag ..... 482/51
5,980,435 A * 11/1999 Joutras et al. ..... 482/114
6,692,410 B1 * 2/2004 Lai ..... 482/52
2002/0155926 A1 * 10/2002 Lat ..... 482/52
2005/0277518 A1 * 12/2005 Fan ..... 482/52

* cited by examiner

*Primary Examiner*—Stephen R. Crow

(57) ABSTRACT

Disclosed is a stepper, which includes a base frame, two pedal frames bilaterally pivotally supported on the base frame, a friction wheel supported on the middle of the rear side of the base frame, two links bilaterally coupled between the pedal frames and the friction wheel for enabling the friction wheel to be alternatively turned forwards and backwards when the pedal frames are alternatively moved up and down by the user, and an adjustment rod rotatably mounted in the base frame to impart a friction resistance to the friction wheel.

2 Claims, 3 Drawing Sheets

STEPPER

BACKGROUND OF THE INVENTION

1. Field of the Invention

The present invention relates to exercising machines and more particularly, to a stepper, which has a simple structure and which uses a friction wheel and a friction block to impart an adjustable damping force to the pedals when the user operating the stepper.

2. Description of the Related Art

Various steppers, climbers and the like are commercially available. These conventional exercising machines commonly use hydraulic cylinder means to impart a damping force to the pedals. The use of such hydraulic cylinder means greatly increases the manufacturing cost of the exercising machine and lowers the manufacturing speed. Further, an exercising machine using hydraulic cylinder means is not durable in use.

SUMMARY OF THE INVENTION

The present invention has been accomplished under the circumstances in view. It is the main object of the present invention to provide a stepper, which has a simple structure and which uses a friction wheel and a friction block to impart an adjustable damping force to the pedals when the user operating the stepper.

To achieve these and other objects of the present invention, the stepper comprises a base frame, the base frame having a front upright tube on a middle of a front side thereof and a horizontal locating frame bar perpendicularly and fixedly connected to the front upright tube and horizontally extending toward a rear side of the based frame; two pedal frames arranged at two sides relative to the horizontal locating frame bar and holding a respective pedal, the pedal frames each having a front coupling rod respectively pivotally connected to the front upright tube of the base frame, the coupling rod having a lug; a friction wheel coupled between a distal end of the horizontal locating frame bar and a rear part of the base frame, the friction wheel having a traction plate disposed at a top side thereof; two links respectively coupled between two distal ends of the traction plate and the lugs at the coupling rods of the pedal frames; and an adjustment rod rotatably mounted in the base frame, the adjustment rod having a friction block disposed in friction contact with the friction wheel.

Further, the links each are comprised of two halves joined by an adjustment nut that is rotatable to adjust the length of the associating link.

DETAILED DESCRIPTION OF THE INVENTION

Figure 2:
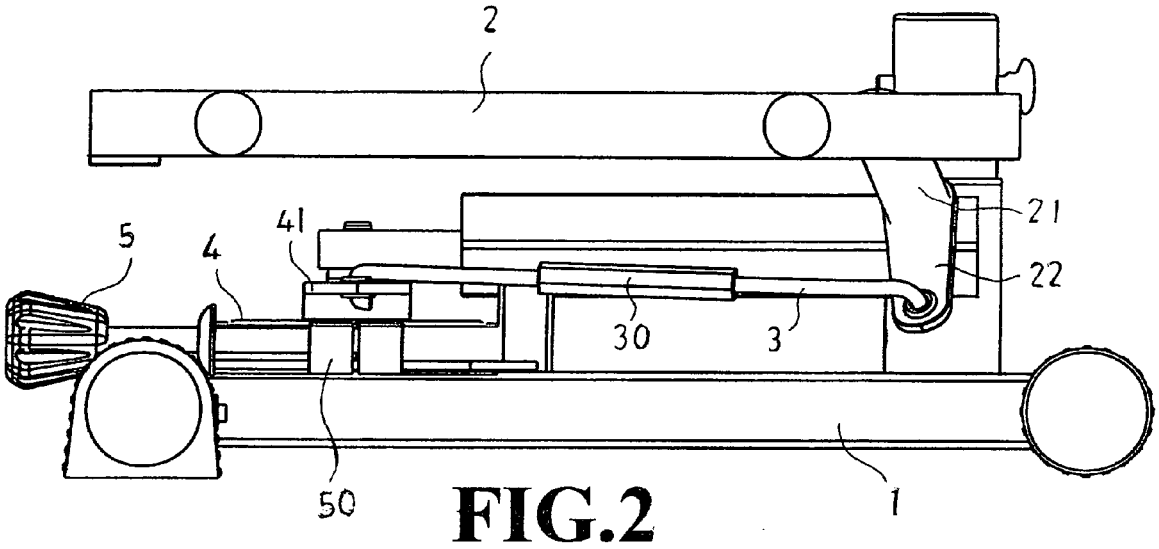
FIG. 2 is a side view of FIG. 1.
Figure 1:
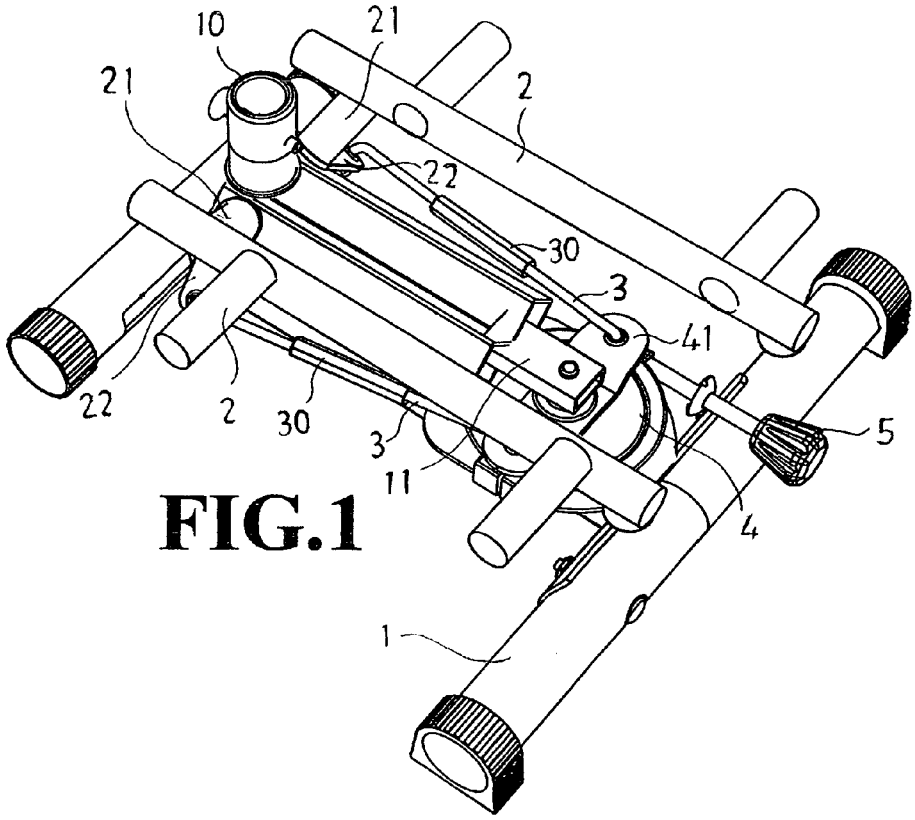
FIG. 1 is an oblique elevation of a stepper in accordance with the present invention (the pedals excluded).
Figure 3:
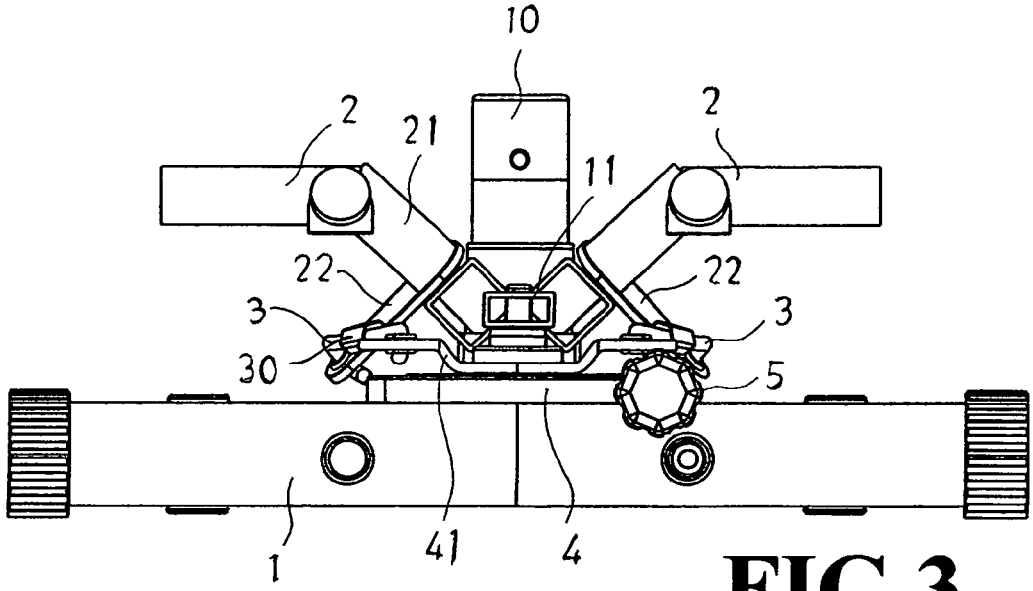
FIG. 3 is a rear elevation of FIG. 1.
Figure 4:
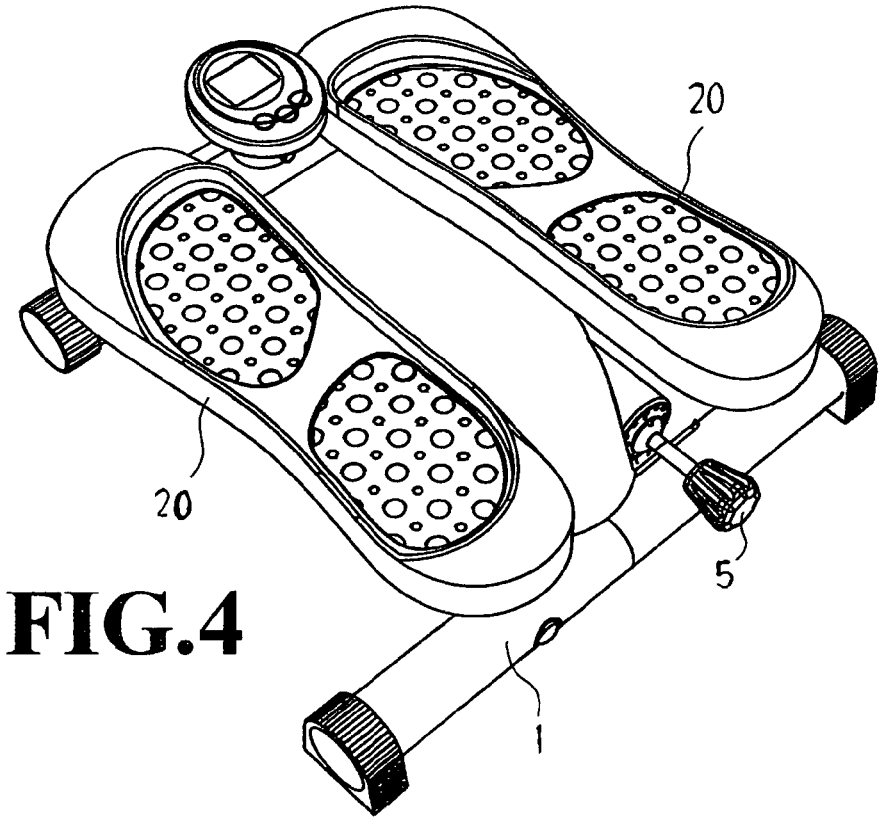
FIG. 4 is an oblique elevation of the stepper after mounting of the pedals.

Referring to FIGS. 1~4, a stepper in accordance with the present invention is shown comprised of a base frame 1, two pedal frames 2, two links 3, a friction wheel 4, and an adjustment rod 5.

The base frame 1 can be steadily positioned on the floor, having a front upright tube 10 on the middle of the front side and a horizontal locating frame bar 11 perpendicularly and fixedly connected to the front upright tube 10 and horizontally extending toward the rear side. The two pedal frames 2 each have a coupling rod 21 respectively pivotally connected to the front upright tube 10 of the base frame 1 at two sides. The coupling rod 21 of each pedal frame 2 has a lug 22. Further, each pedal frame 2 holds a respective pedal 20. The friction wheel 4 is coupled between the free end of the horizontal locating frame bar 11 and a rear part of the base frame 1, having a traction plate 41 disposed at the top side. The two links 3 are respectively coupled between the two distal ends of the traction plate 41 and the lugs 22 at the coupling rods 21 of the pedal frames 2. The adjustment rod 5 is rotatably mounted in the base frame 1, having a friction block 50 disposed in contact with the friction wheel 4. By means of rotating the adjustment rod 5 clockwise or counterclockwise, the friction resistance between the friction wheel 4 and the friction block 50 is relatively adjusted. Further, each link 3 has an adjustment nut 30 on the middle. By means of rotating the adjustment unit 30, the length of the respective link 3 is relatively adjusted.

When in use, the base frame 1 of the stepper is placed on the floor, and then the adjustment nuts 30 are respectively rotated to adjust the length of the links 3 so as to further adjust the elevation of the pedals 20 and the oscillation amplitude of the pedal frames 2, and then rotate the adjustment rod 5 to adjust the friction resistance between the friction wheel 4 and the friction block 50, i.e., to adjust the damping resistance to the pedal frames 2. When stepping one pedal 20 with force to lower the associating pedal frame 2, the associating coupling rod 21 is biased relative to the front upright tube 10 to pull the associating link 3 and to further rotate the friction wheel 4 in one direction through a predetermined angle, thereby causing the other pedal frame 2 to be lifted. Therefore, when the user is stepping the pedals 20, the pedal frames 2 are alternatively moved up and down.

Figure 5:
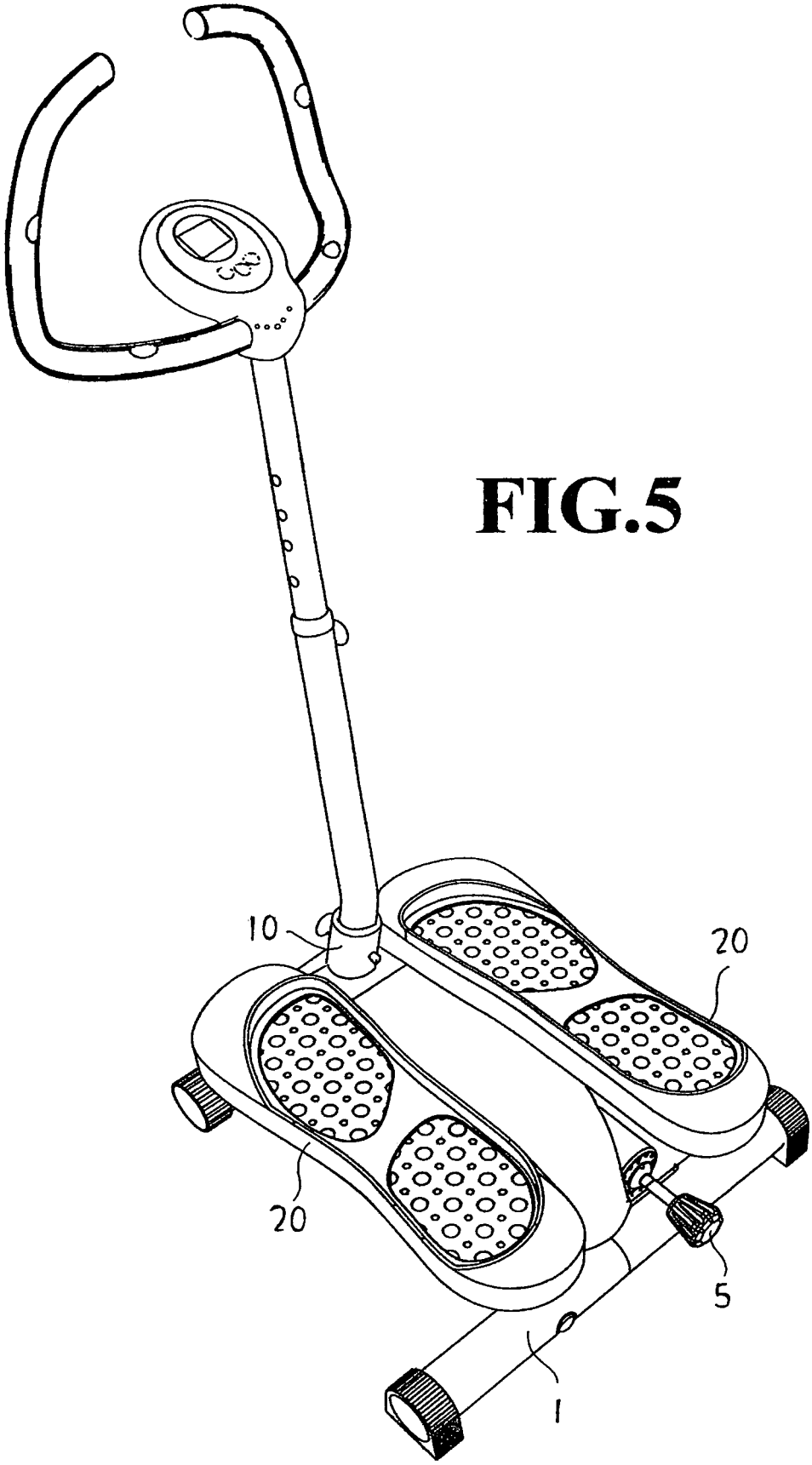
FIG. 5 is an elevational view of an alternate form of the stepper according to the present invention.

FIG. 5 shows an alternate form of the present invention. This embodiment is substantially similar to the embodiment shown in FIGS. 1~4 with the exception of the added handlebar and instrument panel assembly.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A stepper comprising:

a base frame, said base frame having a front upright tube on a middle of a front side thereof and a horizontal locating frame bar perpendicularly and fixedly connected to said front upright tube and horizontally extending toward a rear side of said based frame;

two pedal frames arranged at two sides relative to said horizontal locating frame bar and holding a respective pedal, said pedal frames each having a front coupling rod respectively pivotally connected to said front upright tube of said base frame, said coupling rod having a lug;

a friction wheel coupled between a distal end of said horizontal locating frame bar and a rear part of said base frame, said friction wheel having a traction plate disposed at a top side thereof;

two links respectively coupled between two distal ends of said traction plate and the lugs at the coupling rods of said pedal frames; and an adjustment rod rotatably mounted in said base frame, said adjustment rod having a friction block disposed in friction contact with said friction wheel.

2. The stepper as claimed in claim 1, wherein said links each are comprised of two halves joined by an adjustment nut that is rotatable to adjust the length of the associating link.

* * * * *